United States Patent [19]

McCall et al.

[11] 3,944,129

[45] Mar. 16, 1976

[54] CORRUGATED SHIPPING TRAY WITH AIR SPACE SURROUNDINGS

[75] Inventors: Richard J. McCall, Crystal Lake, Ill.; Marvin Wolfe, Port Washington, N.Y.

[73] Assignee: Mack-Chicago Corporation, Chicago, Ill.

[22] Filed: Nov. 18, 1974

[21] Appl. No.: 524,877

[52] U.S. Cl. ..... 229/32; 229/DIG. 14

[51] Int. Cl.[2] ..... B65D 5/26; B65D 5/22

[58] Field of Search ..... 229/31, 32, DIG. 4, DIG. 5, 229/DIG. 14

[56] References Cited

UNITED STATES PATENTS

| | | | |
|---|---|---|---|
| 711,813 | 10/1902 | Austin et al. | 229/32 |
| 743,205 | 11/1903 | Tupper et al. | 229/32 |
| 2,033,285 | 3/1936 | Harvey | 229/DIG. 14 |
| 2,993,633 | 7/1961 | Keller | 229/33 |
| 3,085,608 | 4/1963 | Mathues | 229/DIG. 14 |
| 3,399,819 | 9/1968 | Remnie et al. | 229/31 R |
| 3,499,596 | 3/1970 | McCormick | 229/32 |

*Primary Examiner*—Davis T. Moorhead

*Attorney, Agent, or Firm*—Hill, Gross, Simpson, Van Santen, Steadman, Chiara & Simpson

[57] ABSTRACT

A foldable corrugated shipping tray has a one-piece blank which is scored, stripped, and cut for assembly into a rectangular tray with vertical sides and ends, the ends having portions which raise the tray bottom to create an air space below.

6 Claims, 7 Drawing Figures

Fig. 4
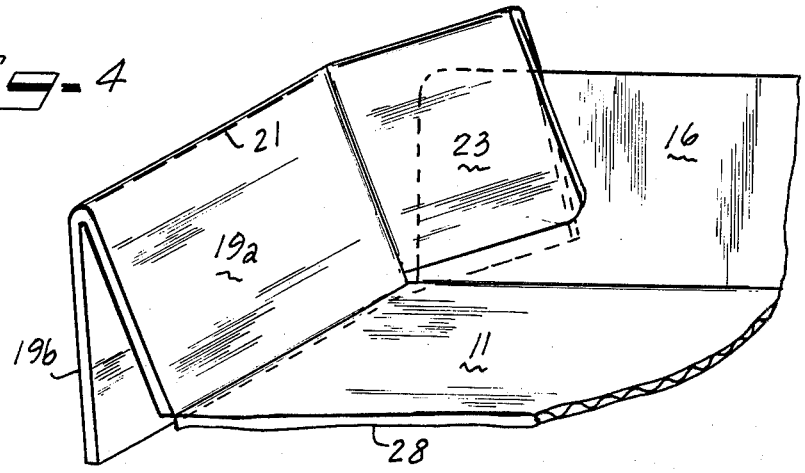
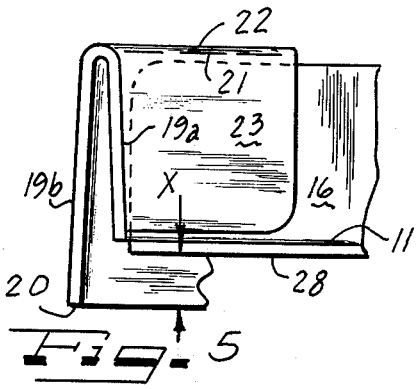
Fig. 5
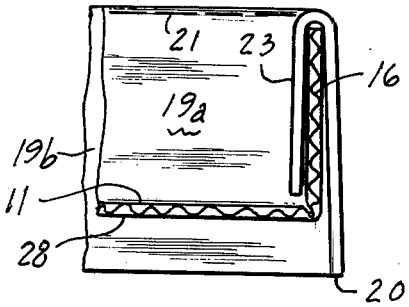
Fig. 6
Fig. 7
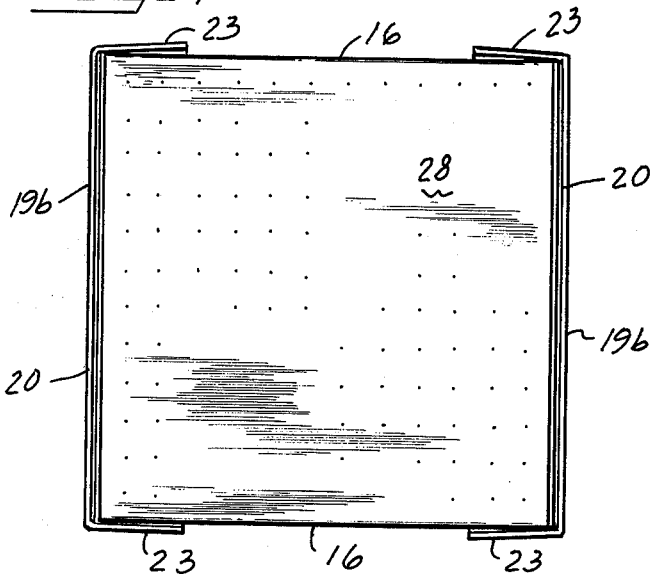

CORRUGATED SHIPPING TRAY WITH AIR SPACE SURROUNDINGS

BACKGROUND OF THE INVENTION

1. Field of the Invention

This invention relates to an improved shipping tray for use either independently or stacked with others in another container.

2. Description of the Prior Art

It is generally known to fold cardboard blanks into boxes of various sizes and shapes and to use pieces of such material in multiple layers to cushion, separate, and protect items for storage or shipment, as in U.S. Pat. Nos. 2,942,768 and 3,550,834 to one of the co-applicants. Prior art devices which provide air spaces for circulation and/or cushioning generally have employed multiple pieces separately placed or assembled to form separators among the trays or boxes.

SUMMARY OF THE INVENTION

In accordance with the principles of this invention, a flat sheet of corrugated material may be scored to form five panels. A rectangular panel centered on the sheet has two parallel side edges which join two side panels to the central panel along side folds and perpendicular to the side edges, two end panels are connected to the central panel at end edges along end folds. Each end panel, in turn, is scored twice down its length, parallel to the end folds, and the outer edge folded under the sheet and beneath the end edge of the rectangular panel. Flaps at either end of the length of the end panel are then folded upward. The side panels are also folded upward, perpendicular to the rectangular panel. The end panels are then folded upward, engaging between the inner and outer portions of the end flaps on the end panel. When the end panels are in their vertical position, the rectangular panel is raised above any underlying supporting surface by extensions of the outer portions of the folded end panels beyond the edges of the rectangular panel.

Air spaces are thereby formed beneath the rectangular panel which forms the bottom of the tray, and air spaces are also formed between the folded portions of the end panels and along the side panels of the tray away from their overlaps with the end flaps of the end panel. One or more surfaces of the rectangular panel and other panels may be treated to be moisture and infestation resistant, and any of the panels may be perforated to increase the circulation of air about the surfaces. The corrugations in the material used for the shipping tray should run perpendicularly to the end edges of the central rectangular panel so that the vertical end panel sections may have maximum strength in the vertical direction.

BRIEF DESCRIPTION OF THE DRAWINGS

FIG. 4 shows the engagement of the side panel between the folds of an end panel end flap during final assembly of the tray.

FIG. 5 shows a cross-section of the completed tray along lines V—V through an end panel.

FIG. 6 shows a cross-section of the assembled tray along lines VI—VI through the side panel and end flaps.

FIG. 7 shows the bottom of the completed tray with optional perforations and surface treatment.

DESCRIPTION OF THE PREFERRED EMBODIMENTS

Figure 1:
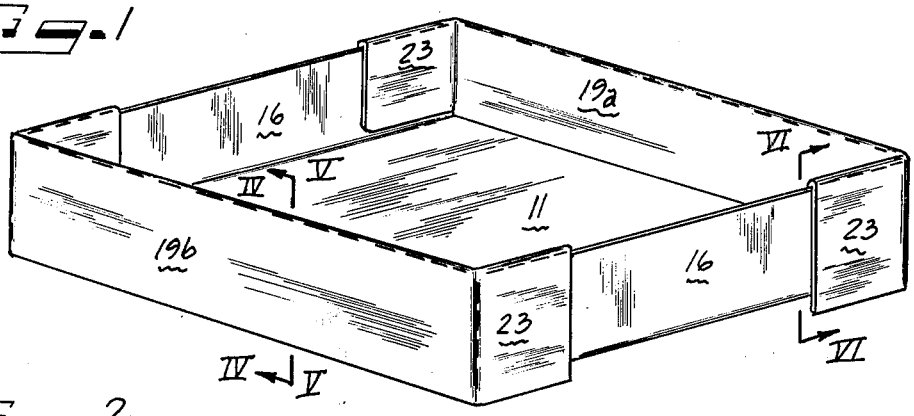
FIG. 1 shows in perspective a folded and assembled tray.

Referring to the drawings, a flat sheet of material 10, preferably corrugated having a thickness t, has a rectangular panel 11 in the center thereof marked by parallel side edges 12 and 13 and parallel end edges 14 and 15. The side edges 12 and 13 separate side panels 16 from the rectangular panel 11. The width of the side panels 16, between edges 12 and 17 or edges 13 and 18 may conveniently be referred to as depth D of the resulting tray.

End panels 19 are separated from the rectangular panel 11 by end edges 14 and 15. Each end panel 19 has a depth D between the end edge 14 or 15 of the rectangular panel 11 and the tray support edges 20 equal to the sum of twice the depth D of the side panels 16, four thicknesses t of the material 10, and the thickness X of the air space desired below the rectangular panel 11, as shown in FIG. 5.

Figure 2:
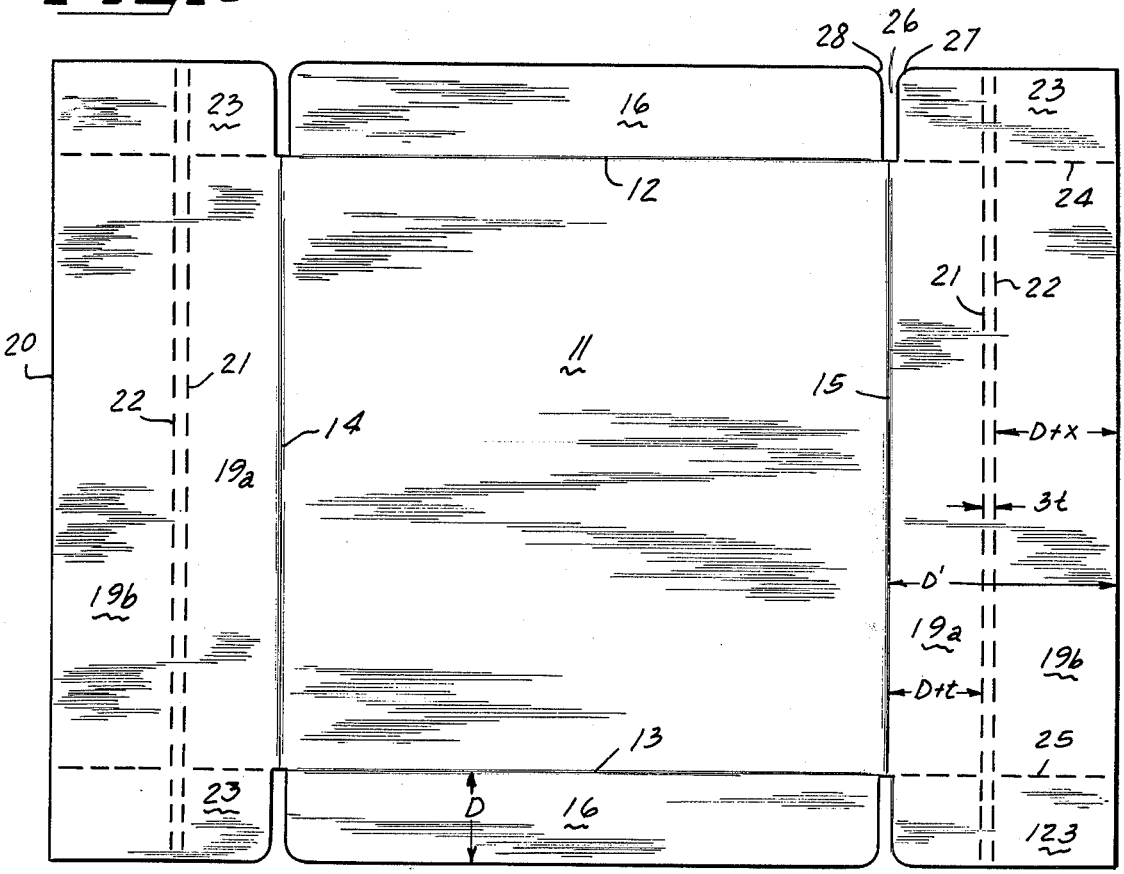
FIG. 2 shows the flat blank from which a tray is folded, with cuts, scores and fold lines.

The end panels 19 have a length parallel to the end edges 14 or 15 of the rectangular panel 11 which conveniently may be equal to the side-to-side dimension of the panel 11 plus twice the depth D of each of the side panels 16, as shown in FIG. 2. Each of the end panels 19 has two longitudinal fold lines 21,22 parallel to the end edges of the rectangular panel 11. A first panel fold line 21 is located at a distance D plus t from the end edge 15 or 14; a second panel fold line 22 is a distance 3t from the line 21. Each end panel 19 has end flaps 23 at either longitudinal end thereof and which is joined to the main portion of the end panel 19 by fold lines 24 and 25 which may be respectively substantially colinear with side edges 12 and 13 of the rectangular panel 11. The end flaps 23 are separated from the side panels 16 by means of gaps or slots 26 formed generally along the end edge lines 14 and 15. The outer ends 27,28 of each of the slots 26 may be rounded into the end flaps 23 and the side panels 16 to facilitate assembly as discussed below. Each slot 26 should be at least one t wide, also to facilitate assembly.

Figure 3:
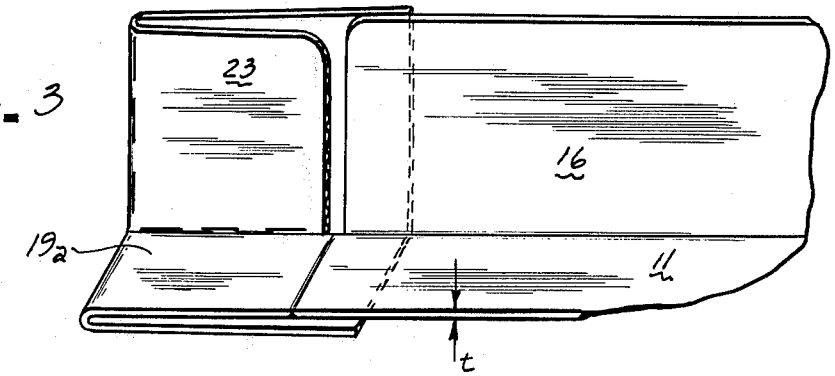
FIG. 3 shows a portion of an end panel and a side panel after the outer edge of the end panel has been folded under the rectangular panel, and the side panel and end panel end flap folded vertical.

The device 10 may be shipped and stored flat until needed. When it is desired to assemble the tray, such assembly may be accomplished as follows. First, the outer end panel portions 19b are each folded along the two panel fold lines 21 and 22 to bring the support edges 20 underneath the rectangular panel 11 and parallel to the end edges 14,15. Each of the folds 21 and 22 should be crisply made in order to provide a space as shown between the inner and outer portions of 19a and 19b of the end panel 19. Second, the side panels 16 are folded upward along the side edges 12 and 13 to a position perpendicular to the face of the rectangular panel 11. Third, each of the end flaps 23, now of double thickness, on one of the end panels 19 is folded upwards along the flap fold lines 24 and 25, to a position perpendicular to the surface of the end panel 19, as shown in FIG. 3. Fourth, the end panel 19 with the end flaps 23 in their perpendicular positions is itself raised perpendicular to the rectangular panel 11, forcing the folded end flaps 23 over the side panels 16, as shown in FIG. 4. Finally, the last two steps are repeated for the other end flaps 23 and end panel 19. The rounded corners 27 and 28 facilitate rapid folding of the tray when the panels 16 or the end flaps 23 are not in precisely perpendicular positions. In the folded position, the support edges 20 will extend below the lower surface of the rectangular panel 11 and keep the bottom of that panel a distance *x* away from the underlying supporting surface. Downward forces on the rectangular panel 11 will tend to force the tray into greater rigidity.

The bottom surface 28 of the rectangular panel 11 may be treated with any of a number of chemicals to resist moisture and/or to repel infestations by insects, vermin, bacteria, or mold, etc. The lower surface may also be perforated as in FIG. 7 to increase the air flow through and about the lower surface of the material.

It is generally desirable to have the corrugations of the material of the sheet 10 extend from end to end of the rectangular panel 11 as in FIG. 6, so that the corrugations are vertical, or perpendicular to the support edges 20, on the end panel 19 and in flaps 23.

Although various modifications might be suggested by those versed in the art, it should be understood that we wish to embody within the scope of the patent warranted hereon all such modifications as reasonably and properly come within the scope of our contributions to the art.

We claim:

1. A shipping tray comprising:

a rectangular panel having two end and two side edges and having a thickness;

two side panels each connected to a side edge of said rectangular panel by a side fold, each of said side panels further having a side panel depth perpendicular to said side fold and a length substantially equal to the length of said side edge of said rectangular panel;

two end panels each connected to an end edge of said rectangular panel by an end fold, each end panel extending the full length of the end edge of said rectangular panel and a distance beyond each side edge and being separated from each of said side panels by a slot, each end panel having a depth perpendicular to said end fold equal to the sum of twice the side panel depth, approximately four times said rectangular panel thickness, and a distance substantially equal to the thickness of a desired air space, each end panel having two end panel fold lines each parallel to the end edges of the rectangular panel and extending the length of said end panel, the first end panel fold line being a distance from the rectangular panel end edge equal to the depth of a side panel plus approximately one panel thickness and the second end panel fold line being a distance from the first end panel fold line equal to approximately three thicknesses of the material of said rectangular panel, and each end panel further having two flap fold lines each substantially colinear with the corresponding side edge and extending the depth of said end panel and forming end flaps at either end of each end panel;

whereby the panels may be folded in relation to one another to form a tray having a rectangular bottom and vertical sides and which is supported a distance above an underlying flat surface by said end panels to create an air space therebelow, and said end flaps capture full-length portions of the side panels between the folds thereof to maintain the tray in its folded condition.

2. A shipping tray as defined in claim 1 and further characterized by said slot between said end flaps and said side panels being flared outwardly at the end of said slot opposite said panel side edge.

3. A shipping tray as defined in claim 1 and further characterized by said rectangular panel being treated on its undersurface to increase its resistance to decay and infestation.

4. A shipping tray as defined in claim 1 and further characterized by said rectangular panel being perforated on its undersurface to increase air circulation about the rectangular panel.

5. A shipping tray as defined in claim 1 and further characterized by the material of said tray being corrugated and the corrugations of said material running perpendicularly to the end edges of the rectangular panel.

6. In a shipping tray formed from a single piece of corrugated material, the improvement of:

folding means by which the material is formed into a tray with air space surroundings below and about four sides thereof; and means to capture full-length portions of side panels thereof between doubly-folded end flaps formed by said folding means.

* * * * *